US010001336B2

(12) United States Patent
Brown

(10) Patent No.: US 10,001,336 B2
(45) Date of Patent: Jun. 19, 2018

(54) AUTO SEAR ACTUATION LINKAGE FOR COMPACT AR-PLATFORM FIREARM

(71) Applicant: AMBIMJB, LLC, Baltimore, MD (US)

(72) Inventor: Michael Jay Brown, Baltimore, MD (US)

(73) Assignee: AMBIMJB, LLC, Baltimore, MD (US)

( * ) Notice: Subject to any disclaimer, the term of this patent is extended or adjusted under 35 U.S.C. 154(b) by 120 days.

(21) Appl. No.: 15/267,803

(22) Filed: Sep. 16, 2016

(65) Prior Publication Data

US 2018/0080732 A1 Mar. 22, 2018

(51) Int. Cl.

| | |
|---|---|
| ***F41A 19/00*** | (2006.01) |
| ***F41A 19/46*** | (2006.01) |
| ***F41A 3/66*** | (2006.01) |
| ***F41A 19/12*** | (2006.01) |

(52) U.S. Cl.
CPC ..... *F41A 19/46* (2013.01); *F41A 3/66* (2013.01); *F41A 19/12* (2013.01)

(58) Field of Classification Search
CPC ..... F41A 3/26; F41A 19/00; F41A 19/12
USPC ..... 89/149, 194, 144, 132
See application file for complete search history.

(56) References Cited

U.S. PATENT DOCUMENTS

| | | | | |
|---|---|---|---|---|
| 2,482,758 | A | 9/1949 | Gaidos | |
| 3,318,192 | A | 5/1967 | Miller et al. | |
| 3,776,095 | A | 12/1973 | Atchisson | |
| 6,782,791 | B2 * | 8/2004 | Moore | F41A 3/22 89/1.4 |
| 6,976,416 | B2 | 12/2005 | Ealovega | |
| 7,137,217 | B2 * | 11/2006 | Olson | F41A 5/02 42/15 |
| 7,975,595 | B2 | 7/2011 | Robinson et al. | |
| 8,985,007 | B2 | 3/2015 | Larson et al. | |
| 9,151,558 | B1 | 10/2015 | Hirt et al. | |
| 9,759,504 | B2 * | 9/2017 | Geissele | F41A 19/12 |
| 2007/0051236 | A1 | 3/2007 | Groves et al. | |
| 2018/0031343 | A1 * | 2/2018 | Caudle | F41A 11/02 |

OTHER PUBLICATIONS

Mahtook, Raymond A., United States Statutory Invention Registration No. H926 titled "Rimfire Blank Adaptor Kit for M16 Rifles," published on Jun. 4, 1991.

* cited by examiner

*Primary Examiner* — J. Woodrow Eldred

(74) *Attorney, Agent, or Firm* — Wood Herron & Evans LLP

(57) ABSTRACT

Disclosed is a mechanism for use with firearms having compact bolt carrier designs without modification of or connection to either the upper or lower receiver. It provides an auto sear trip linkage that is independent of both the upper and lower receivers and which may be used as a "drop in" unit to allow an upper receiver assembly otherwise configured for semi-automatic fire to be used in full-auto mode with a standard, full-auto capable AR-pattern lower receiver.

5 Claims, 4 Drawing Sheets

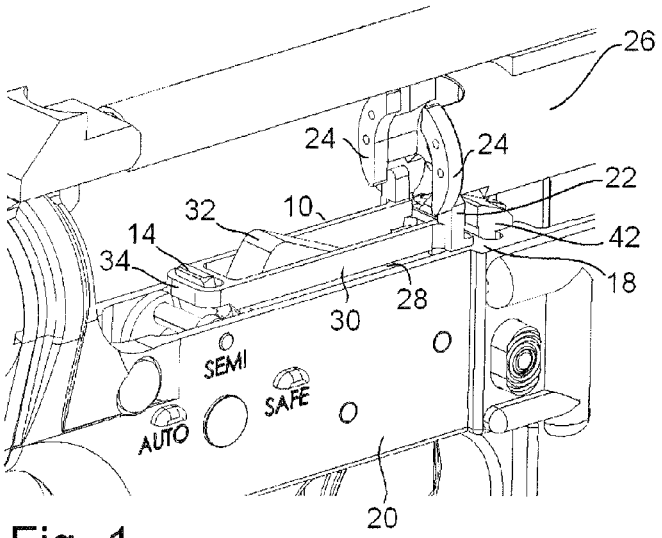
Fig. 1
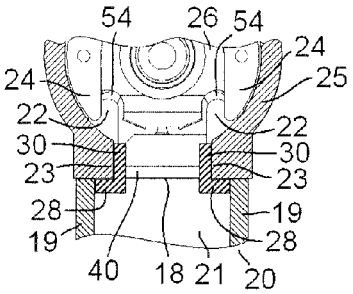
Fig. 3
Fig. 2
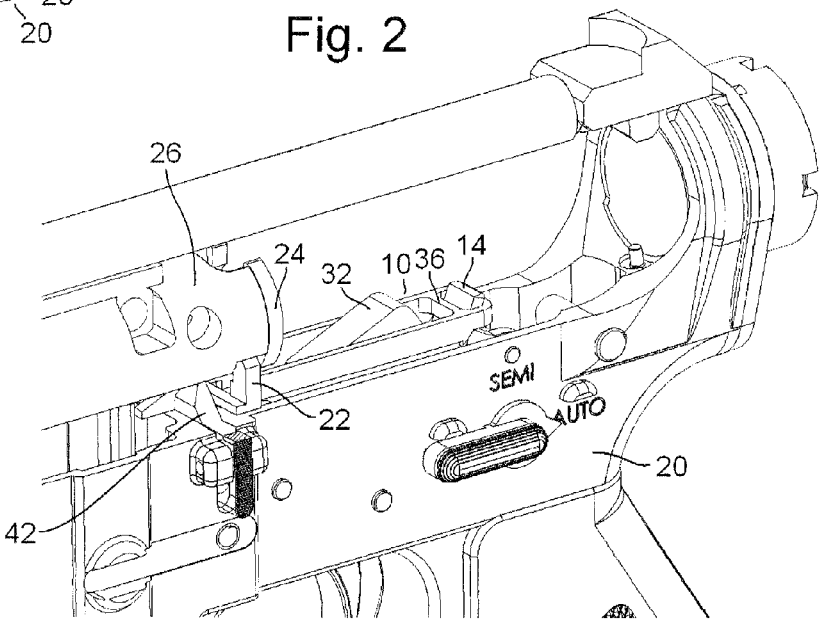

AUTO SEAR ACTUATION LINKAGE FOR COMPACT AR-PLATFORM FIREARM

FIELD OF THE INVENTION

The present invention relates to fully automatic or select-fire firearms. More particularly, it provides a device for actuating the auto sear in an AR-platform firearm having a shortened bolt carrier.

BACKGROUND OF THE INVENTION

An AR-pattern firearm (which includes, but is not limited to, the AR15, AR10, M16, M4, and clones of these) has separable upper and lower receivers. The lower receiver houses the fire control group of parts, including the hammer, trigger, disconnector, and, when capable of fully automatic fire (i.e., a machine gun), an auto sear. The upper receiver houses a longitudinally reciprocating bolt and bolt carrier. In a typical configuration, the bolt carrier extends substantially the entire length of the upper receiver and moves rearwardly beyond the confines of the upper receiver when the action cycles. In this typical configuration, a recoil spring and buffer are housed in an extension positioned reward of the upper receiver.

In compact versions, in which the recoil spring is housed within the upper receiver, usually actuated by a gas piston system, or having a simple blowback bolt, such in a pistol caliber carbine, there is no need for the bolt carrier to extend the full length of the upper receiver or to reciprocate beyond the confines of the upper receiver. Operating systems of this type allow for the use of a folding stock and/or eliminate the need for an extension to house the recoil spring and buffer in a pistol configuration. However, these compact bolt carriers are unable to trip the auto sear, which has to be tripped just prior to the bolt carrier and bolt returning to its full in-battery position, where it is situated in a standard lower receiver without significant modification to the shortened bolt carrier.

Others have proposed solutions to this challenge with "lost motion" or "slip" linkage devices that attach to and require modification of the upper receiver. For example, U.S. Pat. No. 8,667,882, issued Mar. 11, 2014, shows one such device which attaches to the upper receiver and reciprocates on elongated grooves or channels machined on the interior of the upper receiver. Another example is shown by U.S. Pat. No. 9,151,558, issued Oct. 6, 2015, which uses a sear trip bar that is held slidably captive in a groove machined on one side of the interior of the upper receiver. In rim-fire conversion devices for AR-platform firearms, auto sear trip bars have been integrated into or attached to an elongated structure that replaces the standard bolt carrier, or that are carried within the upper receiver. One example is shown in U.S. Pat. No. 3,776,095, issued Dec. 4, 1973.

SUMMARY OF THE INVENTION

One example embodiment provides an auto sear trip link for use in a firearm having separable upper and lower receivers, an auto sear, and a bolt carrier that longitudinally reciprocates substantially completely within the upper receiver without extending rearward beyond a rear end of the receivers. The link includes a pair of laterally spaced apart longitudinally extending members unconnected to the upper receiver and configured to fit at least partially between lateral sidewalls of the lower receiver and edges of a bottom opening in the upper receiver. The link has a forward portion configured to rest on an upper surface of the lower receiver and a rearward portion configured to be supported by an auto sear installed in the lower receiver. At least one engagement horn extends upwardly from the forward portion of the member. A first rear crossmember interconnects a rearward portion of the longitudinally extending members and is configured to operatively engage the auto sear. A reciprocating bolt carrier slides within the upper receiver between a forward, in-battery position and a rearward, recoil position. The carrier has at least one boss at a rear end thereof configured to engage the horn as the bolt carrier reaches an in-battery position, thereby moving the trip link and tripping the auto sear to initiate a firing cycle.

Another example embodiment provides a firearm auto sear trip linkage, including a longitudinally extending link member having a pair of laterally spaced apart elongated beams, a forward end and a rearward end. The link member is unconnected to a firearm upper receiver when installed and is configured to fit at least partially between lateral sidewalls of a firearm lower receiver and edges of a bottom opening in the upper receiver. The link member has a forward end portion configured to rest on an upper surface of the lower receiver and a rearward end portion configured to be supported by an auto sear in the lower receiver. At least one engagement horn extends upwardly from a forward end portion of the link member and is configured to be operatively interfaced with a bolt carrier of the firearm. A rear cross-member connects the beams at the rearward end and is configured to operatively interface with the auto sear.

Another example embodiment provides a firearm including an upper receiver, a lower receiver, a bolt carrier that longitudinally reciprocates substantially completely within the upper receiver without extending rearward beyond a rear end of the receivers, and an auto sear in the lower receiver. The bolt carrier has at least one longitudinal bottom groove and at least one boss having a portion longitudinally aligned with a rear end of the bottom groove. A longitudinally extending link member with forward and rearward ends includes a pair of laterally spaced apart and longitudinally extending beams, a horn at the forward end configured to pass through the bottom groove and to operatively interface with the boss, and a rear crossmember interconnecting a rearward portion of the beams configured to operatively interface with the auto sear. The link member is unconnected to the upper and lower receivers, and is supported at the rearward end by the auto sear and at the forward end by resting on an upper surface of the lower receiver such that, upon sufficient forward displacement of the bolt carrier within the firearm, the link member trips the auto sear to initiate a firing cycle.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various figures of the drawings, wherein:

FIGS. 1 and 2 are partial isometric views of an auto sear trip mechanism according to an embodiment of the present invention with the upper receiver removed for clarity;

FIG. 3 is a forward-looking cross-sectional view showing the position of an auto sear trip link relative to the upper and lower receivers

DETAILED DESCRIPTION OF THE INVENTION

Figure 6:
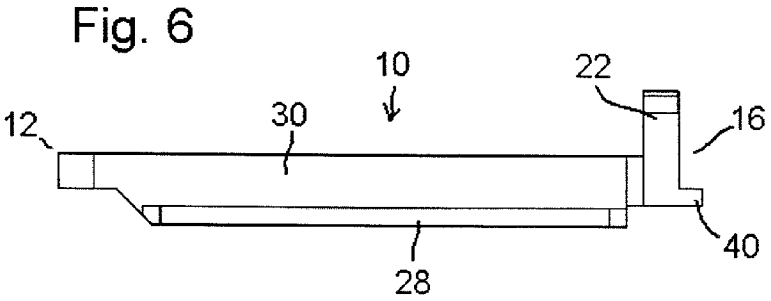
FIG. 6 is a side elevation view thereof.
Figure 8:
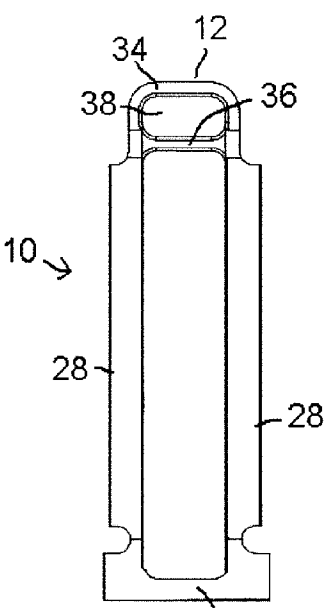
FIG. 8 is a bottom plan view thereof.
Figure 7:
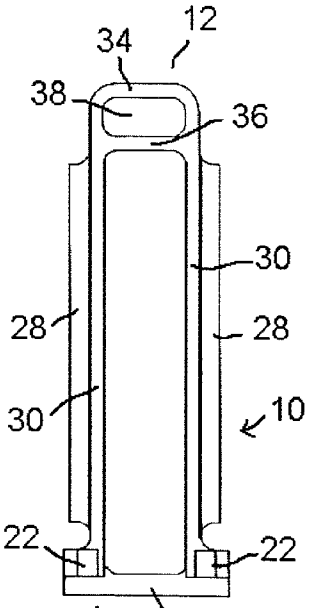
FIG. 7 is a top plan view thereof.
Figure 4:
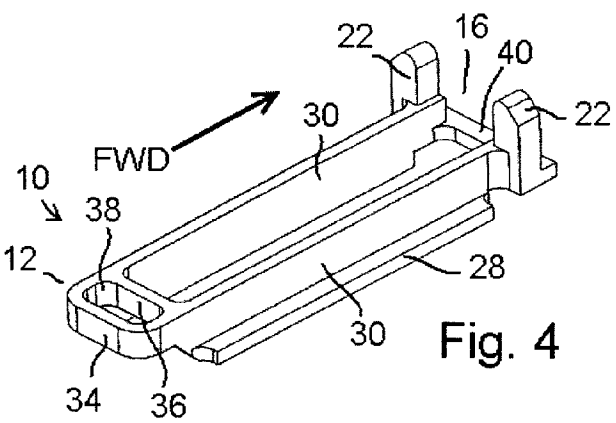
FIGS. 4 and 5 are isometric views of an auto sear trip link according to an embodiment of the invention.
Figure 5:
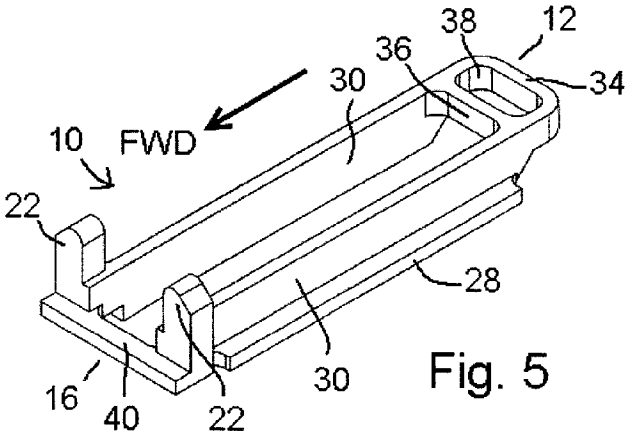

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

The structure and operation of AR-pattern firearms in both semi-automatic and fully automatic modes are generally well known. As previously described, the bolt carrier in a typical configuration includes a reward extension capable of tripping the auto sear as the bolt goes into battery when the selector is positioned to "auto." An example is shown and described in U.S. Pat. No. 3,045,555 issued Jul. 24, 1962. This rearward extension of the bolt carrier is unnecessary and not usually found in configurations where the recoil spring is housed within the upper receiver, rather than in a rear housing extension.

The present invention provides a mechanism for using such compact bolt carrier designs without modification of or connection to either the upper or lower receiver. It provides an auto sear trip linkage that is independent of both the upper and lower receivers and which may be used as a "drop in" unit to allow an upper receiver assembly otherwise configured for semi-automatic fire to be used in full-auto mode with a standard, full-auto capable AR-pattern lower receiver.

Referring first to FIGS. 1 and 2, therein is shown at 10 a linkage member according to an embodiment of the present invention. A rearward end 12 of the linkage member 10 engages and is supported by an upper extension of the auto sear 14. The forward end 16 rests on an upper surface 18 of the lower receiver 20. One or more upwardly extending horns 22 at the forward end 16 are releasably engaged by left and/or right bolt carrier auto sear bosses 24 at the rearward end of the bolt carrier 26.

Referring also to FIGS. 3-8, the linkage member 10 may be configured to fit between unmodified side walls 19 defining a fire control compartment 21 of the lower receiver 20. In this regard, the member 10 may include laterally extending side flanges 28 configured to guide forward and rearward reciprocation of the linkage member 10 between side walls 19 of the lower receiver 20. Likewise, the linkage member 10 may include longitudinal beams 30 configured to fit and longitudinally reciprocate between unmodified edges 23 of the upper receiver 25 defining a bottom access slot through which the hammer 32 and auto sear 14 also partially extend. Accordingly, an access slot for the hammer 32 is defined between the longitudinal beams 30. Although only a rear crossmember 34 is required to actuate the auto sear 14, the linkage member 10 may also include a second rear crossmember 36 situated forward of the auto sear 14. In this manner, the rear crossmember 34 and second rear crossmember 36 may define a pocket opening 38 configured to receive the upwardly extending lever of the auto sear 14 and rest thereon. This pocket opening 38 may limit the rearward travel of the linkage member 10 and prevent the forward end 16 from dropping off of the upper surface 18 of the lower receiver 20. The forward end 16 of the linkage member 10 may also include a forward crossmember 40 to provide rigidity and maintain proper spacing between the horns 22, and to rest on the upper surface 18 of the lower receiver 20 behind the bolt catch 42. In FIG. 2, the upper actuator paddle of the bolt catch 42 is cut-away so as not to obscure detail of the present invention.

Orientation of the longitudinal beams 30 and flanges 28 provides structural rigidity for the linkage member 10, which is supported only at its ends 12, 16. The vertical orientation provides a web resistant to vertical forces. The horizontal orientation of the flange 28 strengthens the web against lateral forces. This allows the linkage member 10 to be very lightweight and use minimal material, while being resistant to deformation. Operational forces on the linkage member will be primarily longitudinal tension as engagement of the bosses 24 against the horns 22 at the forward end 16 pulls it forward as the bolt carrier 26 approaches the in-battery position and engagement with the auto sear 14, biased by the spring 44, at its rearward end 12 pulls it rearward when the bosses 24 disengage from the horns 22 when the bolt carrier 26 travels rearward or is locked back.

Figure 9:
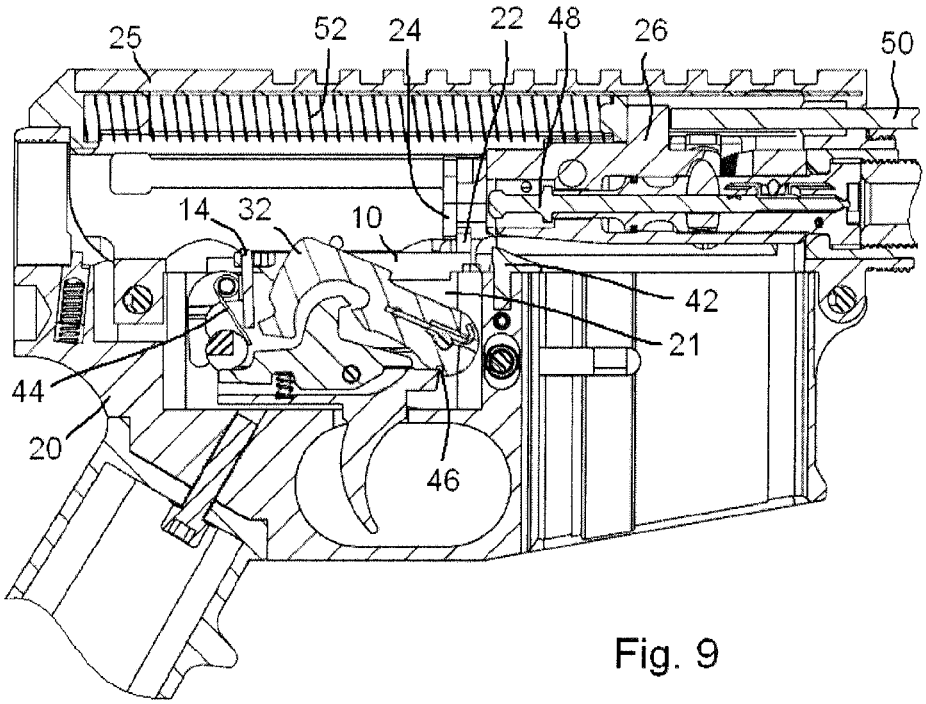
FIGS. 9-12 are a series of side sectional views showing the bolt carrier and fire control mechanism in sequential stages of operation.

Referring now to FIGS. 9-12, therein is shown a series of views illustrating sequential stages in the operation of a full-auto firearm using the auto sear linkage of the present invention. For clarity, no ammunition cartridge or magazine is shown in these views. FIG. 9 Illustrates the firearm with the bolt and bolt carrier 26 fully in-battery and with the hammer 32 cocked and ready to fire. The linkage member 10 is supported at its rearward end 12 by the auto sear 14 and at its forward end 16 by the upper surface 18 of the lower receiver 20. The horns 22 are engaged by the bosses 24 of the bolt carrier 26, pulling the linkage member 10 forward and, in turn, rotating the auto sear 14 against the force of a torsion spring 44 to a "tripped" position. In this condition, with the trigger not pulled, the hammer 32 is held by the trigger sear 46.

Figure 10:
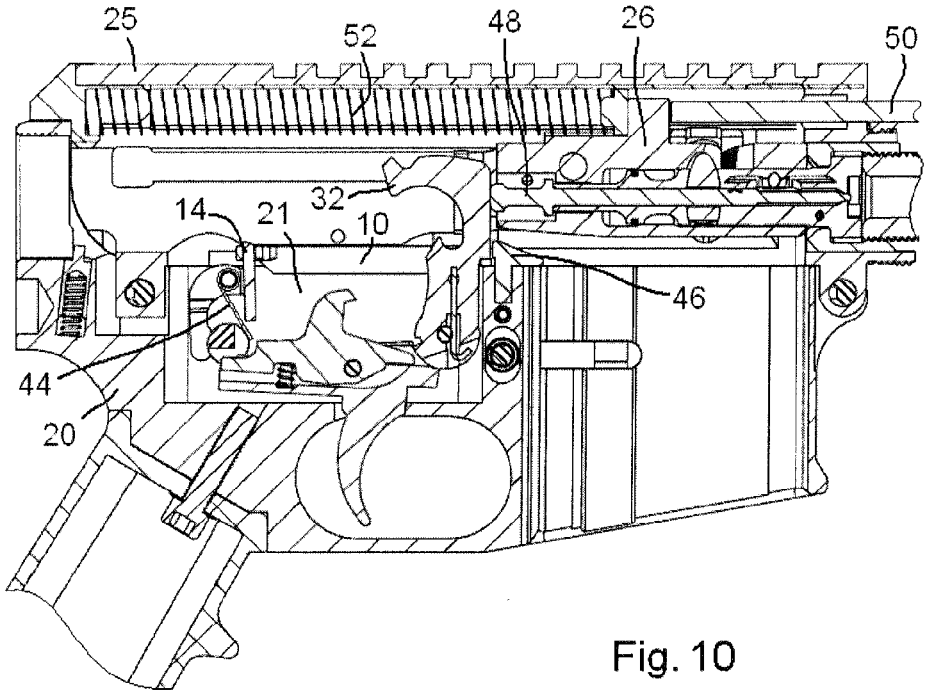

Referring to FIG. 10, when the operator pulls the trigger (as illustrated), releasing engagement between the trigger sear 46 and hammer 32, the hammer 32 is rotated by spring force into the position shown, striking the firing pin 48.

Figure 11:
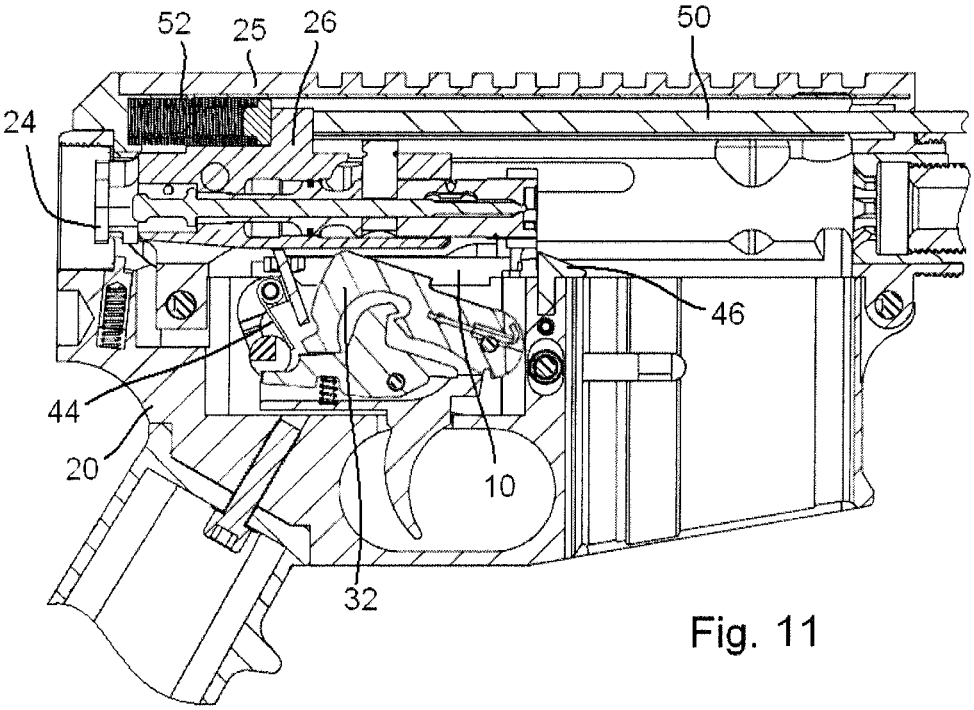

As is well known with respect to gas-operated auto-cycling firearms, when a cartridge (not shown) is discharged, propellant is ignited creating gas pressure and pushing the projectile through the bore of the barrel. Some of the gas pressure from the burning propellant is diverted through a port in the barrel and provides energy to cycle the action. As shown in FIG. 11, the bolt carrier 26 assembly is driven rearwardly, such as by an operating rod 50 connected to a gas piston (not shown). The recoil spring 52 is compressed by the force and the bolt carrier 26 pushes the hammer 32 down, resetting it. The rearward end of the bolt carrier 26, including the bosses 24, remains substantially within the longitudinal profile of the upper receiver 25 and/or lower receiver 20, as shown. The horns 22 of the linkage member 10 are no longer engaged by the bosses 24 of the bolt carrier 26 at this stage, allowing the linkage member 10 to be moved rearwardly as the auto sear 14 is rotated by the force of the auto sear torsion spring 44. Grooves 54 in the bottom of the bolt carrier 26, which accommodate the upper feed lips of an ammunition magazine (not shown) when the bolt carrier 26 is in a forward position, allow the horns 22 to pass as the bolt carrier 26 cycles rearward. If an ammunition magazine (not shown) were in place and the last round had been fired, the magazine follower would lift the bolt catch 42 and hold the bolt carrier 26 in this position.

Figure 12:
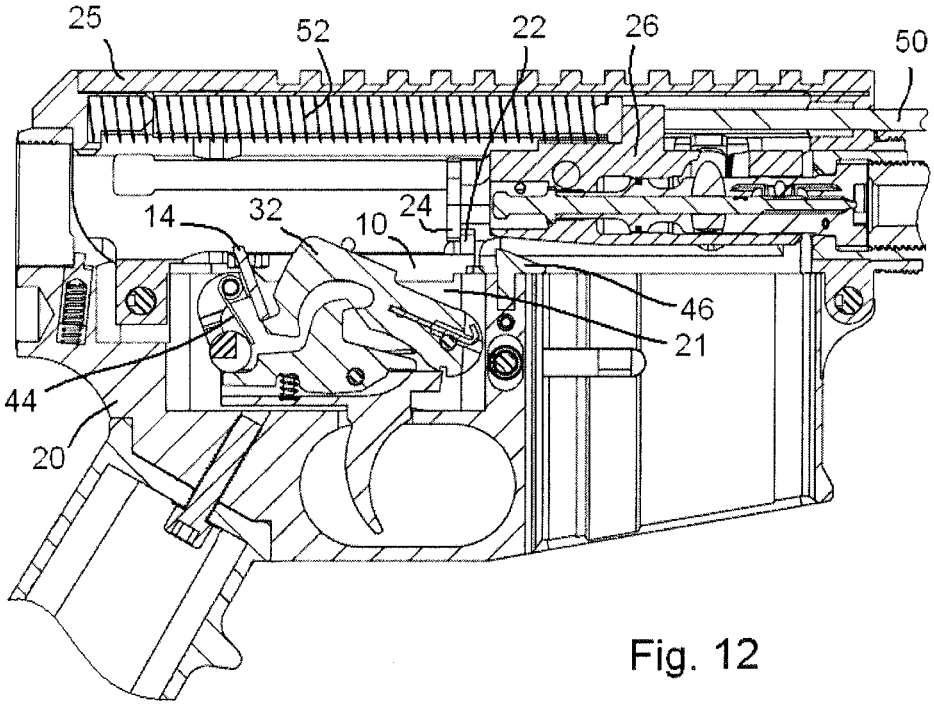

If ammunition remains, the recoil spring 52 then returns the bolt carrier 26 assembly forward, as shown in FIG. 12. The torsion spring 44 biases the auto sear 14 into position to catch the hammer 32, as shown. In FIG. 12, the bolt carrier 26 is shown at a position just prior to reaching full in-battery position. Here, the bosses 24 on the bolt carrier 26 come into engagement with the horns 22 of the linkage member 10. As the bolt carrier 26 continues forward into battery, the linkage member 10 is pulled forward, causing rotation of the auto sear 14. If the trigger remains pulled, the hammer 32 is released by the auto sear 14, allowing another round to be fired. The sequence will then continue to the stage and position illustrated in FIG. 10. If the trigger has been released, the trigger sear 42 will engage the hammer, as shown in FIG. 9, and firing will cease.

While one embodiment of the present invention has been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. In a firearm having separable upper and lower receivers, an auto sear, and a bolt carrier that longitudinally reciprocates substantially completely within the upper receiver without extending rearward beyond a rear end of the receivers, an auto sear trip link, comprising:

a pair of laterally spaced apart longitudinally extending members unconnected to the upper receiver and configured to fit at least partially between lateral sidewalls of the lower receiver and edges of a bottom opening in the upper receiver, the member having a forward portion configured to rest on an upper surface of the lower receiver and a rearward portion configured to be supported by an auto sear installed in the lower receiver;

at least one engagement horn extending upwardly from the forward portion of the member;

a first rear crossmember interconnecting a rearward portion of the longitudinally extending members and configured to operatively engage the auto sear; and a reciprocating bolt carrier that slides within the upper receiver between a forward, in-battery position and a rearward, recoil position, the carrier having at least one boss at a rear end thereof configured to engage the horn as the bolt carrier reaches an in-battery position, thereby moving the trip link and tripping the auto sear to initiate a firing cycle.

2. The auto sear trip link of claim 1, wherein each of the longitudinally extending members includes a substantially vertically oriented web portion that when installed is at least partially positioned between edges of a bottom opening in the upper receiver and a substantially horizontally extending flange portion positioned at least partially between lateral sidewalls of the lower receiver.

3. The auto sear trip link of claim 1, further comprising a second rear crossmember positioned forward of the first rear crossmember to define a pocket opening between the crossmembers to engage a portion of the auto sear.

4. A firearm auto sear trip linkage, comprising:

a longitudinally extending link member having a pair of laterally spaced apart elongated beams, a forward end and a rearward end, the link member being unconnected to a firearm upper receiver when installed and configured to fit at least partially between lateral sidewalls of a firearm lower receiver and edges of a bottom opening in the upper receiver, the link member having a forward end portion configured to rest on an upper surface of the lower receiver and a rearward end portion configured to be supported by an auto sear in the lower receiver;

at least one engagement horn extending upwardly from a forward end portion of the link member and configured to be operatively interfaced with a bolt carrier of the firearm; and a rear cross-member connecting the beams at the rearward end and configured to operatively interface with the auto sear.

5. A firearm, comprising:

an upper receiver and a lower receiver;

a bolt carrier that longitudinally reciprocates substantially completely within the upper receiver without extending rearward beyond a rear end of the receivers, the bolt carrier having at least one longitudinal bottom groove and at least one boss having a portion longitudinally aligned with a rear end of the bottom groove; and an auto sear in the lower receiver;

a longitudinally extending link member with forward and rearward ends, comprising:

a pair of laterally spaced apart and longitudinally extending beams;

a horn at the forward end configured to pass through the bottom groove and to operatively interface with the boss; and a rear crossmember interconnecting a rearward portion of the beams configured to operatively interface with the auto sear;

wherein the link member is unconnected to the upper and lower receivers, and is supported at the rearward end by the auto sear and at the forward end by resting on an upper surface of the lower receiver such that, upon sufficient forward displacement of the bolt carrier within the firearm, the link member trips the auto sear to initiate a firing cycle.

* * * * *